US007765641B2

(12) United States Patent
Cunningham

(10) Patent No.: US 7,765,641 B2
(45) Date of Patent: Aug. 3, 2010

(54) CENTRAL VACUUM CLEANING SYSTEM BATTERY HOUSING AND HANDLE

(75) Inventor: J. Vern Cunningham, Aurora (CA)

(73) Assignee: Cube Investments Limited, Aurora (CA)

( * ) Notice: Subject to any disclaimer, the term of this patent is extended or adjusted under 35 U.S.C. 154(b) by 906 days.

(21) Appl. No.: 11/321,058

(22) Filed: Dec. 30, 2005

(65) Prior Publication Data

US 2007/0151073 A1 Jul. 5, 2007

(51) Int. Cl.
*A47L 9/32* (2006.01)

(52) U.S. Cl. ..... 15/410; 15/314

(58) Field of Classification Search ..... 15/301, 15/312, 312.2, 314, 315, 321, 410, DIG. 1
See application file for complete search history.

(56) References Cited

U.S. PATENT DOCUMENTS 4,829,626 A * 5/1989 Harkonen et al. ..... 15/314
5,298,821 A * 3/1994 Michel ..... 310/47
5,713,656 A * 2/1998 Lin ..... 362/120
5,816,685 A * 10/1998 Hou ..... 362/205
6,033,082 A * 3/2000 Lin ..... 362/120
6,795,993 B2 * 9/2004 Lin ..... 15/28
7,122,921 B2 * 10/2006 Hall et al. ..... 310/50
2004/0049868 A1 * 3/2004 Ng ..... 15/22.2

* cited by examiner

*Primary Examiner*—Dung Van Nguyen
(74) *Attorney, Agent, or Firm*—Dowell & Dowell, P.C.

(57) ABSTRACT

A central vacuum cleaning system hose handle uses a battery, and has a battery compartment and a battery housing. Battery housing is interchangeable with power plug housing. When housing is drawer then drawer and handle have slide mechanism on which drawer extends in and out. First stop limits depth drawer can slide in. Second stop limits depth drawer can extend out. External access prevented when drawer extended to first stop, permitted when drawer extended to second stop. Releasable locking mechanism inhibits drawer from extending out when handle in use. Crib releasably retains battery. Spring electrical contacts at opposing ends of crib. Crib generally formed to profile of battery. Drawer oriented generally parallel to longitudinal wand adapter axis of handle, crib opening away from axis. Alternatively, housing has body with internal chamber to receive battery and an opening to provide access through an aperture in the handle to the chamber.

40 Claims, 9 Drawing Sheets

CENTRAL VACUUM CLEANING SYSTEM BATTERY HOUSING AND HANDLE

FIELD OF THE INVENTION

The invention relates to central vacuum cleaning systems. More particularly, it relates to hose handles for central vacuum cleaning systems.

BACKGROUND OF THE INVENTION

Central vacuum cleaning systems were originally quite simple. One placed a powerful central vacuum source external to the main living space. The source was connected through interior walls to a long flexible hose that terminated in a handle and nozzle. When an operator desired to use the system, the operator went to the source and turned it on. The operator then went inside, picked up the handle and directed the nozzle to an area to be cleaned.

Although many elements of the basic system remain, many improvements have been made. Rigid pipes typically run inside interior walls to numerous outlets spaced throughout a building. This allows an operator to utilize a smaller hose while covering an equivalent space. This is an advantage as the hose can be quite bulky and heavy.

Various communication systems have been developed. Some systems sense sound or pressure in the pipes to turn the vacuum source on or off, see for example U.S. Pat. No. 5,924,164 issued 20 Jul. 1999 to Edward W. Lindsay under title ACOUSTIC COMMUNICATOR FOR CENTRAL VACUUM CLEANERS. Other systems run low voltage wires between the source and the outlet. The source can be turned on and off at an outlet by a switch that may be activated by insertion or removal of the hose. The hose may also contain low voltage wires to allow the source to be controlled from a switch in the handle, see for example U.S. Pat. No. 5,343,590 issued 6 Sep. 1994 to Kurtis R. Radabaugh under title LOW VOLTAGE CENTRAL VACUUM CONTROL HANDLE WITH AN AIR FLOW SENSOR. The switch can be a simple toggle switch, or a more sophisticated capacitive switch.

The low voltage wires running along the pipes can be replaced by conductive tape or the like on the pipes, see for example U.S. Pat. No. 4,854,887 issued 8 Aug. 1989 to Jean-Claude Blandin under title PIPE SYSTEM FOR CENTRAL SUCTION CLEANING INSTALLATION. Separate low voltage conductors in the walls can be avoided altogether by using mains power wires to transmit communication signals between the outlet and the source, see for example U.S. Pat. No. 5,274,878 issued 4 Jan. 1994 to Kurtis R. Radabaugh et al under title REMOTE CONTROL SYSTEM FOR CENTRAL VACUUM SYSTEMS. A handheld radio frequency wireless transmitter can be used by an operator to turn the source on or off, see for example U.S. Pat. No. 3,626,545 issued 14 Dec. 1971 to Perry W. Sparrow under title CENTRAL VACUUM CLEANER WITH REMOTE CONTROL.

Line voltage is brought adjacent the vacuum outlets and connected through separate conductors, or integrated spiral wound conductors on the hose, to the handle. Line voltage can then be brought from the handle to powered accessories, such as a power beater bar, connected to the nozzle. Line voltage can be switched on and off to the powered accessory using the same switch in the handle that controls the source. Alternatively, the powered accessory may have its own power switch.

Improvements to, or alternative or additional features for, central vacuum cleaning systems are desirable.

SUMMARY OF THE INVENTION

In a first aspect the invention provides a combination for use within a central vacuum cleaning system. The combination includes a central vacuum cleaning system hose handle including a battery compartment, and a battery housing for releasably retaining a battery. The battery compartment is within the handle and has an aperture through the handle to provide external access to the compartment through the handle. The housing has an open position and a closed position. External access to the battery is prevented when the housing is in the closed position. External access to the battery is permitted when the housing is in the open position.

The battery housing may be interchangeable with an attachment power plug housing such that the hose handle may be combined with either the battery housing or the plug housing. The battery housing may have an external profile similar to the plug housing.

The housing may be a drawer. The drawer and compartment may have a slide mechanism on which the drawer can be extended into and out of the handle through the aperture. The drawer and compartment may have a first stop to limit the depth to which the drawer can slide into the handle through the aperture. The drawer and compartment may have a second stop to limit the depth to which the drawer can be extended out of the handle through the aperture. External access to the battery may be prevented when the drawer is extended into the handle to the first stop. External access to the battery may be permitted when the drawer is extended out of the handle to the second stop.

The slide mechanism may have a combination of rails and guides on the drawer and compartment. The slide mechanism may have a combination of rails on the drawer and guides on the compartment.

The drawer and compartment may have a releasable locking mechanism to inhibit the drawer from extending out of the compartment when the handle is in use. The slide mechanism may have a releasable locking mechanism to inhibit the drawer from extending out of the compartment when the handle is in use. The drawer and compartment may have a boss that inhibits the drawer from extending out of the compartment when the handle is in use. The drawer may have a boss on one of the rails to releasably engage the handle at the aperture to inhibit the drawer from extending out of the compartment when the handle is in use.

The handle may have an external shell, and the aperture is in the shell.

The drawer may have a crib, and the drawer may releasably retain the battery in the crib. The drawer may have a first contact at one end of the crib and a second contact at an opposing end of the crib, with the drawer releasably retaining the battery between the contacts in the crib. At least one of the contacts may be a spring contact to releasably retain the battery between the contacts within the crib.

The crib may have a bed that is generally formed to a longitudinal profile of the battery. The crib may have a curved bed for receiving a cylindrical battery. The drawer may be oriented generally parallel to a longitudinal wand adapter axis of the handle with the crib opening away from the wand adapter axis. The crib may open from beneath the wand adapter axis when the handle is held in a normal operating position with the wand adapter axis directed downwardly.

In a second aspect the invention provides a battery drawer for use in a central vacuum cleaning system hose handle having a compartment for retaining a central vacuum cleaning system attachment power plug and an aperture through the handle to provide external access to the plug. The drawer has a first slide mechanism portion, a first stop surface, and a second stop surface. The battery drawer releasably retains the battery. The first slide mechanism portion acts in combination with the compartment to provide a slide mechanism on which the drawer can be extended into and out of the handle through the aperture. The first stop surface acts in combination with the compartment to provide a first stop to limit the depth to which the drawer can slide into the handle through the aperture. The second stop surface in combination with the compartment provides a second stop to limit the depth to which the drawer can be extended out of the handle through the aperture. External access to the battery is prevented when the drawer is extended into the handle to the first stop. External access to the battery is permitted when the drawer is extended out of the handle to the second stop.

The first slide mechanism portion may have rails. The drawer may have a releasable locking mechanism to inhibit the drawer from extending out of the compartment when the handle is in use. The drawer may have a boss that inhibits the drawer from extending out of the compartment when the handle is in use. The drawer may have a boss on one of the rails to releasably engage the handle at the aperture to inhibit the drawer from extending out of the compartment when the handle is in use.

The drawer may have a crib, with the drawer releasably retaining the battery in the crib. The drawer may have a first contact at one end of the crib and a second contact at an opposing end of the crib. In this case the drawer releasably retains the battery between the contacts in the crib. At least one of the contacts may be a spring contact to releasably retain the battery between the contacts within the crib.

The crib may have a bed that is generally formed to a longitudinal profile of the battery. The crib may have a curved bed for receiving a cylindrical battery. The drawer may be oriented generally parallel to a longitudinal wand adapter axis of the handle with the crib opening away from the wand adapter axis. The crib may open from beneath the wand adapter axis when the handle is held in a normal operating position with the wand adapter axis directed downwardly.

In a third aspect the invention provides a combination for use in a central vacuum cleaning system. The combination includes a central vacuum cleaning system hose handle for use with a battery to power at least one device, and a battery housing retained by the hose handle. The battery housing includes an open position to provide access to the battery external to the handle such that the battery can be removed from or inserted into the housing, and a closed position to retain the battery and prevent access to the battery.

The battery housing may be compatible with a compartment within the hose handle that is also compatible with an attachment power plug housing such that the hose handle may be combined with either the battery housing or the plug housing. The battery housing may have an external profile similar to the plug housing.

The battery housing may be a battery drawer that in the open position drawer extends out of the handle to provide access to the battery external to the handle, and that in the closed position extends into the handle to retain the battery and prevent access to the battery.

The drawer may include a crib with an interior curved bed, opposing first crib end and second crib end, a first electrical contact extending into the crib from the first crib end, and a second electrical contact extending into the crib from the second crib end. The crib and contacts may be dimensioned such that the battery is retained within the crib after the battery is placed is the crib.

The contacts may be spring type contacts that allow the battery to be manually inserted and removed while firm contact is maintained between the contacts and electrodes of the battery when the battery is in the crib.

The drawer and handle may have a plurality of rail/guide combinations spaced about the drawer parallel to a longitudinal axis of the drawer on which the drawer can slide between the open position and the closed position.

The handle may further include an exterior shell that extends about the handle, and an aperture in the shell, and the drawer may slide through the aperture.

The handle may have two attached casing halves. The drawer may be inserted in the handle before the halves are attached.

The drawer and shell may include a manually releasable locking mechanism for the drawer.

The battery housing may include a body which has an internal chamber to receive the battery, and has an opening to provide access through an aperture in the handle to the chamber.

The housing may have a cap that has an open position and a closed position, such that access external to the handle is provided to the battery in the chamber through the aperture when the cap is in the open position, while such access is prevented when the cap is in the closed position.

The attachment of the cap to the body may be temporary. The attachment of the cap to the body may be permanent.

The cap may be hingedly connected to the body, such that the cap swings on a hinge between the open position and closed position. The hinge may be a living hinge.

In the closed position a lock may be provided between the cap and body to prevent the cap from opening inadvertently. The lock may include a boss on one of the cap and body and a corresponding hollow on the other of the cap and body. The battery housing may include a spring mechanism to allow the cap to pop open when unlocked.

The cap may be attached to the body by way of corresponding guide mechanisms, such that the cap slides into and out of the body to cover access to the chamber.

These and other aspects of the invention, including methods thereof, will be evident from the detailed description and FIGS. of the preferred embodiments provided herein.

BRIEF DESCRIPTION OF THE DRAWINGS

For a better understanding of the present invention and to show more were clearly how it may be carried into effect, reference will now be made, by way of example, to the accompanying drawings which show the preferred embodiment of the present invention and in which.

DETAILED DESCRIPTION OF THE PREFERRED EMBODIMENT

Referring to the FIGS., a central vacuum cleaning system hose handle 2100 uses a battery 2102 to power at least one device 2103 such as, for example, a radio frequency (RF) transmitter, RF receiver, RF transceiver or a user interface such as those described in co-pending U.S. patent application Ser. No. 10/936,699 filed 9 Sep. 2004 under title CENTRAL VACUUM CLEANING SYSTEM CONTROL SUB-SYSTEMS the content of which is hereby incorporated by reference in to the detailed description hereof. In the FIGS, the device 2103 is shown generically as utilizing a printed circuit board; although, it should be recognized that the device 2103 is not required to have a printed circuit board. It is to be noted that the battery 2102 may be used to power devices 2103 in the handle 2100 or external to it by way of conductive wires, not shown. The handle 2100 also contains a wand adapter 2104. A hose 2105 is connected to the handle 2100.

The term "battery" is used herein. It is understood that a battery may have one or more cells. The cells may be in one or more discrete packages. The battery may be rechargeable or non-rechargeable. A battery also includes a plurality of batteries. The batteries may be electrically connected in parallel or series.

Figure 1:
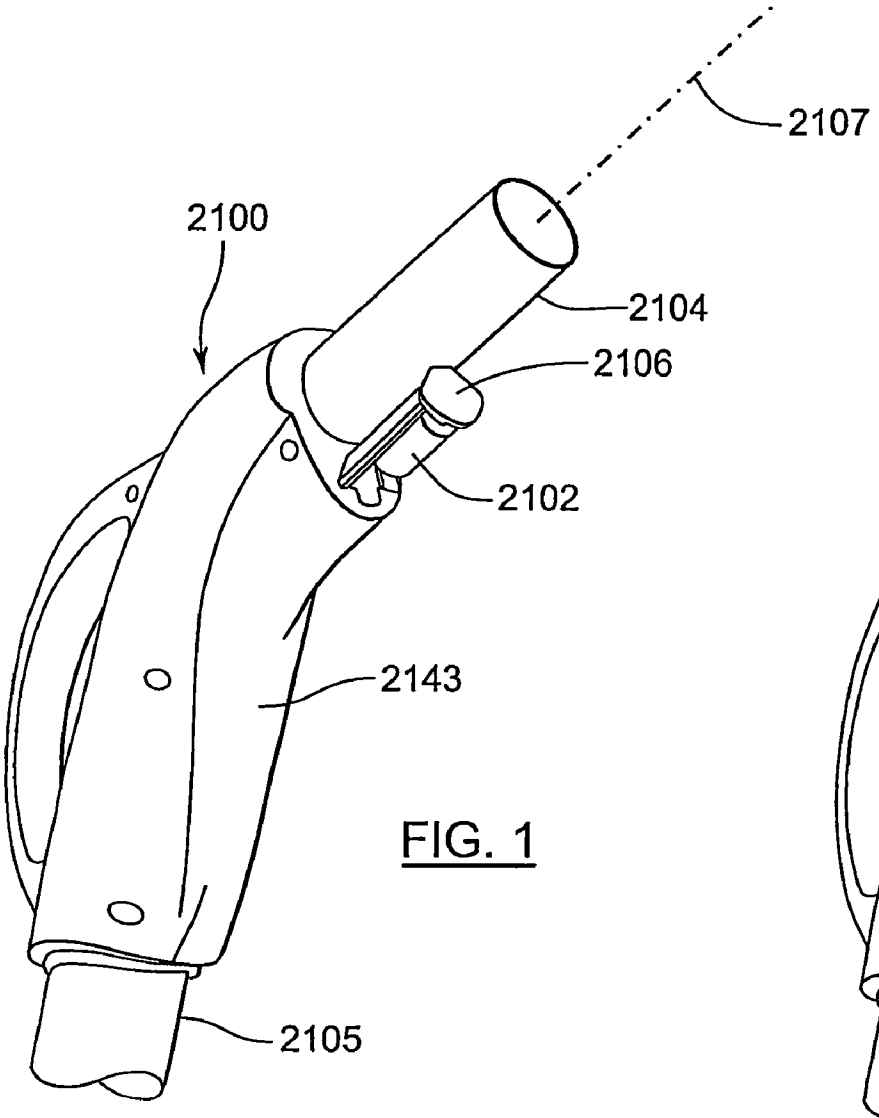
FIG. 1 is a perspective view from below, to the front and one side of a central vacuum cleaning system hose handle with a battery housing in the form of a battery drawer, battery and hose in accordance with a preferred embodiment of the invention with the drawer extended from the handle.

Referring to FIG. 1, in one embodiment, the handle 2100 retains a battery drawer 2106. The battery drawer 2106 acts as a battery housing 2106 for the battery 2102. The drawer 2106 has an open position in which it extends out of the handle 2100 to provide access to the battery 2102 external to the handle 2100. When the battery drawer 2106 is extended the battery 2102 can be removed from or inserted into the drawer 2106 for easy replacement or recharge.

Figure 2:
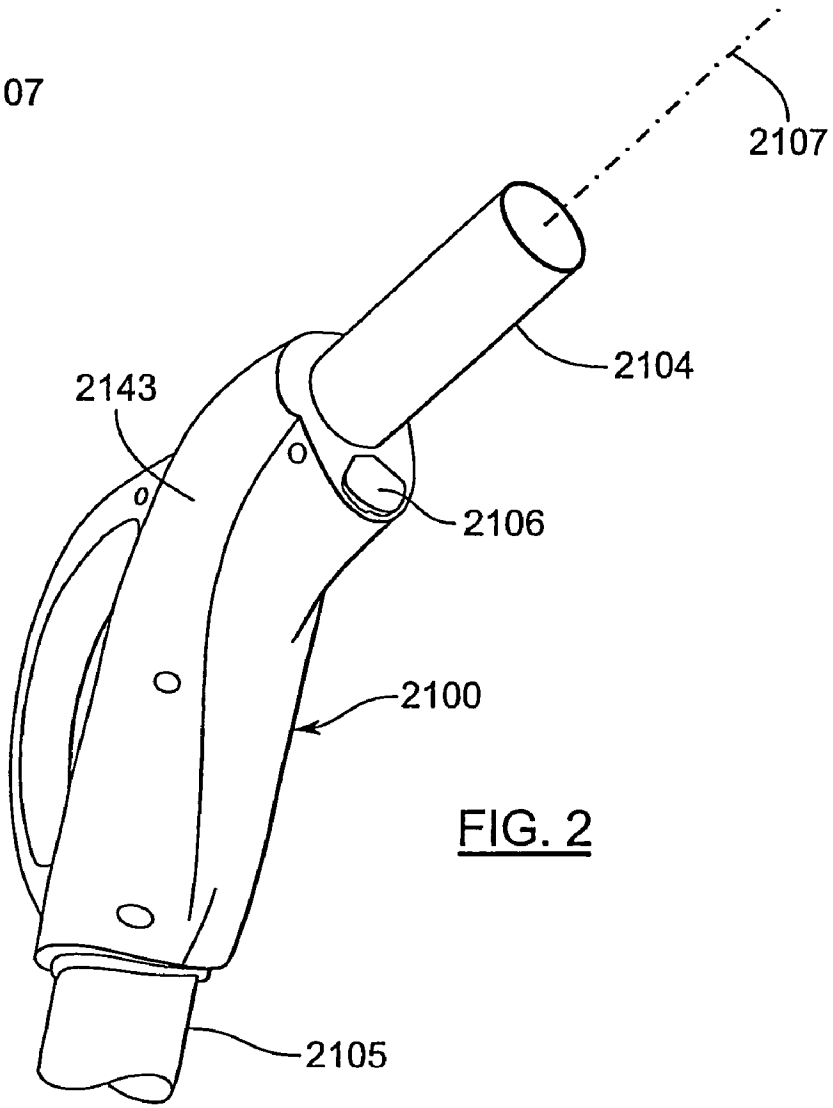
FIG. 2 is the perspective view of the hose handle, drawer and hose of FIG. 1 with the drawer inserted into the handle.

Referring to FIG. 2, the drawer 2106 also has a closed position in which it extends into the handle 2100 to retain and prevent access to the battery 2102.

Figure 11:
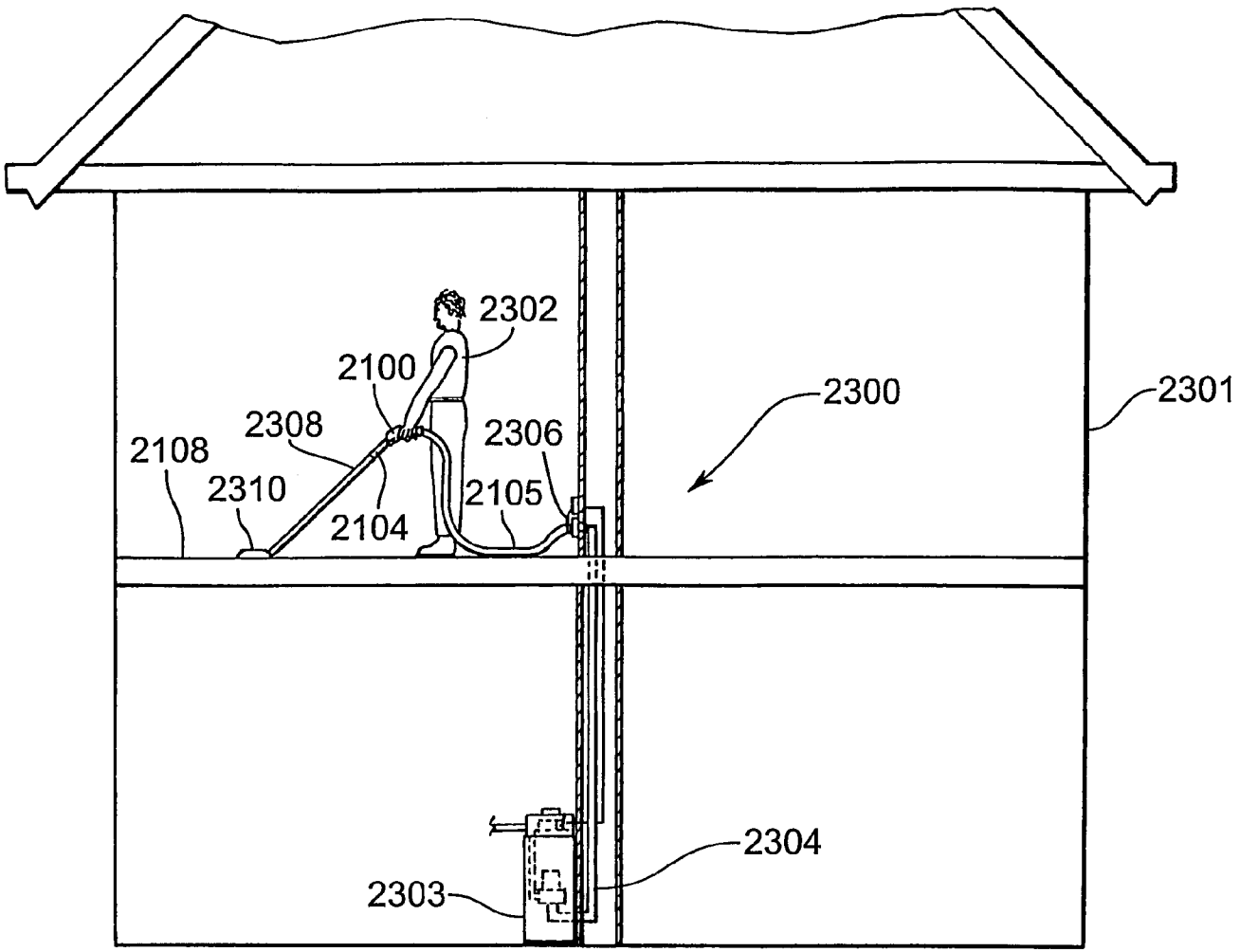
FIG. 11 is a cutaway front view of a building containing a central vacuum cleaning system utilizing the hose handle of FIG. 1.

In this description terms of orientation such as top, bottom, side, front and rear will be used for ease of reference in describing the specific embodiment shown in the FIGS. These terms are used with respect to a longitudinal axis 2107 of the wand adapter 2104 as the adapter 2104 exits the handle 2100 when used in its normal cleaning position with the adapter 2104 angled downwardly from the handle 2100 towards a floor 2108 or other horizontal surface being cleaned (see FIG. 11). Thus, top, bottom and side are generally looking from above, below and to the side, respectively, of the axis 2107 or an object parallel thereto; while, front is closer to the surface being cleaned and rear is further from the surface to be cleaned, in both cases generally looking parallel to the axis 2107. It is to be noted that the principles described herein can be applied in many different orientations.

Referring primarily to FIGS. 4-10, the drawer 2106 has a crib 2109 with an interior curved bed 2110, front crib end 2112 (FIG. 9), and rear crib end 2114. Extending into the crib 2109 from the front crib end 2112 is a front electrical contact 2116 (FIG. 9) and extending into the crib from the rear crib end 2114 is a rear electrical contact 2118.

The crib 2109 and contacts 2116, 2118 are dimensioned such that the battery 2102 (FIG. 1) is releasably retained within the crib 2109 after the battery 2102 is placed is the crib 2109. Preferably the contacts 2116, 2118 are spring contacts that allow the battery 2102 to be easily manually inserted and removed while firm contact is maintained between the contacts 2116, 2118 and electrodes of the battery 2102 when the battery 2102 is in the crib 2109. The drawer 2106 has top rails 2124, 2126, side rails 2128, 2130 and bottom rails 2132, 2134.

Figure 3:
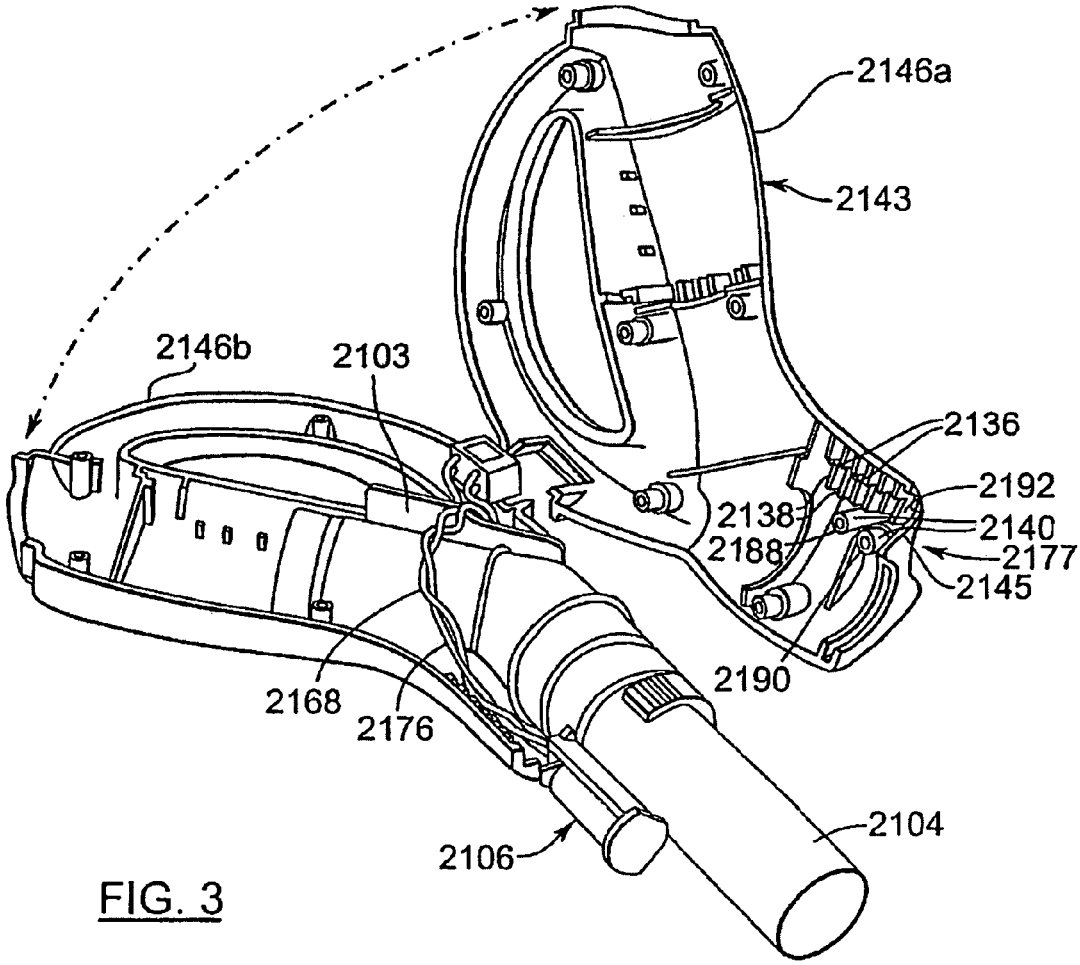
FIG. 3 is an exploded perspective view of FIG. 1 showing two handle shell halves with the battery drawer extended from one shell half.
Figure 4:
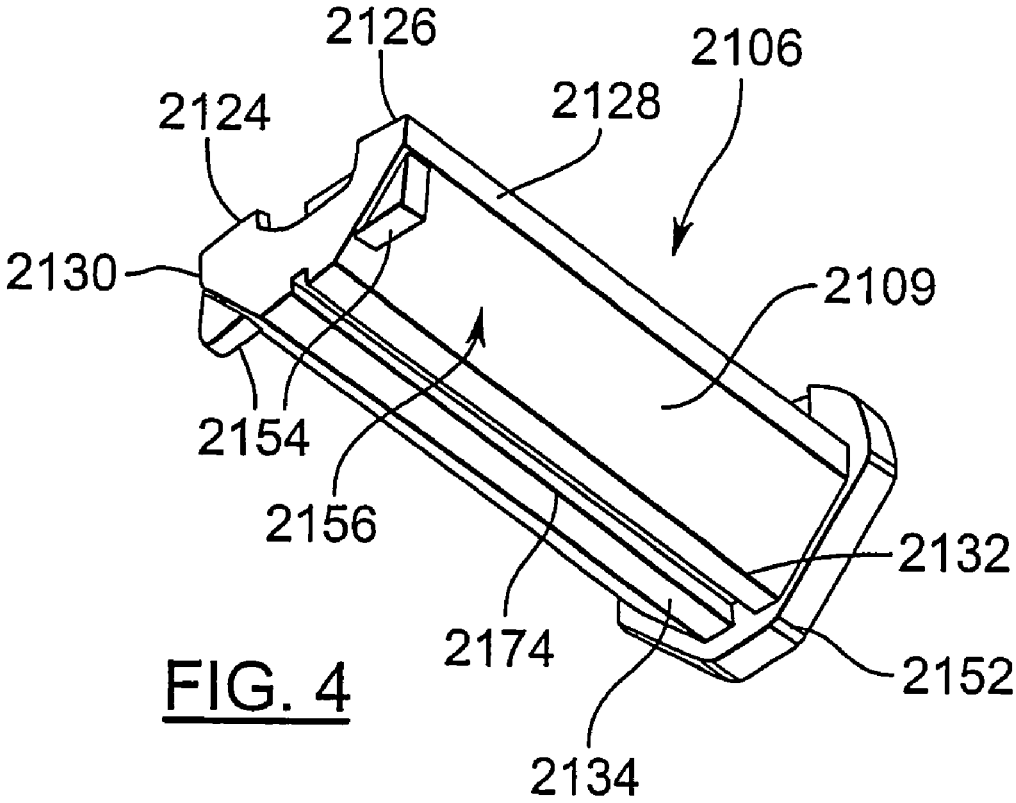
FIG. 4 is a close-up perspective view from above, behind and to one side the same perspective as FIG. 1 of the battery drawer of FIG. 1.
Figure 5:
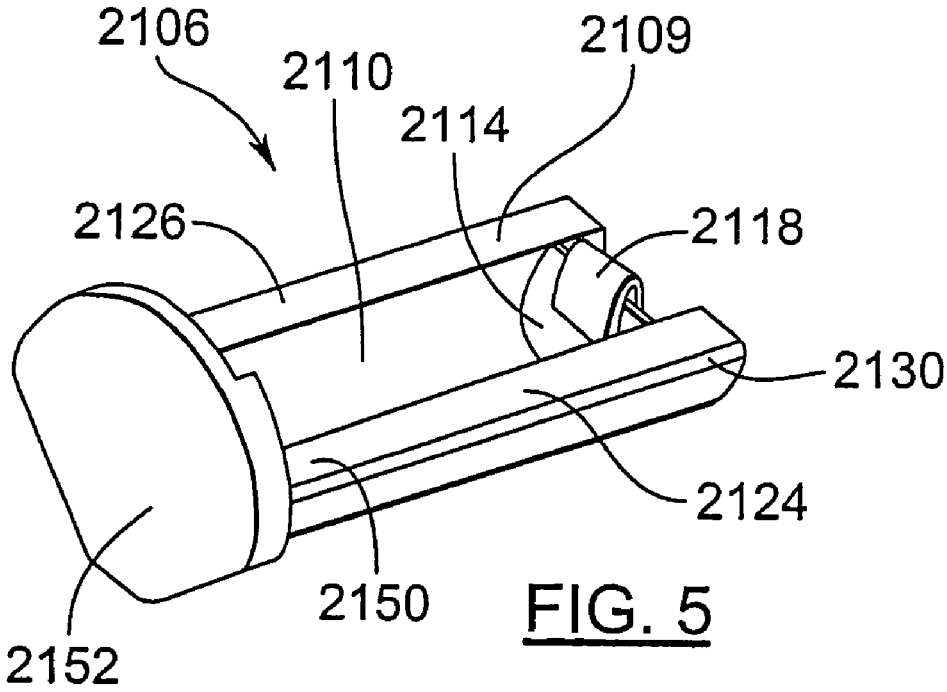
FIG. 5 is a close-up perspective view from below, in front, and to one side of the battery drawer of FIG. 1.
Figure 10:
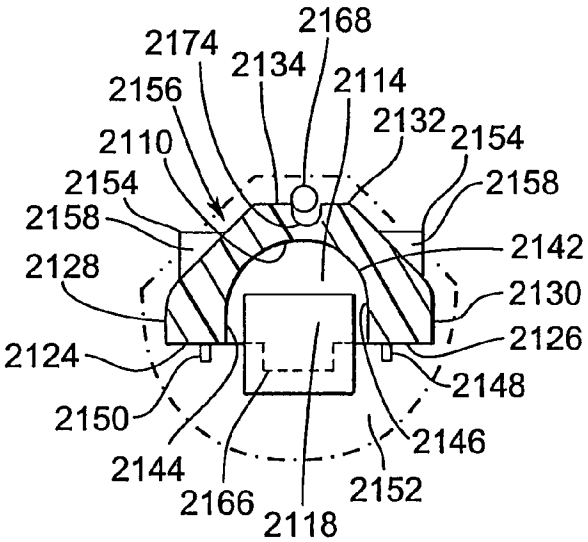
FIG. 10 is a front cross section view of the battery drawer of FIG. 1 through 10-10 of FIG. 8.

Referring to FIG. 3, the handle 2100 has interior surfaces that act as corresponding top guides 2136, side guides 2138 and bottom guides 2140. The rails 2124, 2126, 2128, 2130, 2132, 2134 and the respective guides 2136, 2138 and 2140 allow the drawer 2106 to slide smoothly in and out of the handle 2100.

The handle 2100 has an exterior shell 2143 that extends about the handle 2100. An aperture 2145 in the shell 2143 also provides an aperture 2145 in the handle 2100. The drawer 2106 slides through the aperture 2145 into the handle 2100. As can be seen in an exploded view of the handle 2100, the handle 2100 is most easily manufactured in two casing halves **2146*a*, 2146*b*. The casing halves 2146*a*, 2146*b*** can be attached using various methods, such as screws, not shown.

A portion of the guides 2136, 2138, 2140 is shown in the FIG. on casing half **2146*a*. It is understood that casing half 2146*a* has a corresponding portion of the guides 2136, 2138, 2140. The portions of the guides 2136, 2138, 2140 on the respective halves 2146*a*, 2146*b* are not necessarily symmetrical. The aperture 2145 is also formed partially by casing half 2146*a* and partially by casing half 2146*b*. This allows the drawer 2106 to be inserted in the handle 2100 before the halves 2146*a*, 2146*b*** are attached.

The drawer 2106 has a boss 2148 on the bottom rail 2124 and a boss 2150 on the bottom rail 2126. As the drawer 2106 slides into the handle 2100 the bosses 2148, 2150 engage the shell 2143. The bosses 2148, 2150 and shell 2143 are sufficiently hard, yet elastic to allow the bosses 2148, 2150 to pass over the shell 2143 with an applied force, while preventing the drawer 2106 from sliding back out of the handle 2100 during ordinary use of the handle 2100. The bosses 2148, 2150 and shell 2143 in combination provide a manually releasable locking mechanism for the drawer 2106. As will be evident to those skilled in the art, other manually releasable locking mechanisms may be used.

The drawer 2106 has a generally flat end cap 2152 at least some portion of which is larger than the aperture 2145 extending over the shell 2143. The cap 2152 meets the shell 2143 and acts as a stop for the drawer 2106 to limit the distance that the drawer 2106 is inserted into the handle 2100. The bosses 2148, 2150 are set back from the end cap 2152 approximately the depth of the shell 2143 to hold the cap 2152 against the shell 2143. As well as limiting the chance that the drawer 2106 will inadvertently open, the drawer 2106 is limited from shaking about when in the closed position such that the battery 2102 might be caused to disengage from the contacts 2116, 2118.

The drawer 2106 has flanges 2154 outwardly extending from an overside 2156 of the drawer. Respective stop surfaces 2158 of the flanges 2154 meet the shell 2143 and act as a stop to limit the distance that the drawer 2106 can be extended out of the handle 2100. The stop surfaces 2158 are positioned behind the rear crib end 2114 to permit the drawer 2106 to extend sufficiently to allow the interior of the crib to be fully accessible from outside the handle 2100.

Between the side rails 2128, 2130 and their respective top rails 2124, 2126, overside 2160 of the drawer 2106 is inwardly angled. This permits the flanges 2154 to project outwardly while not extending further than the side rails 2128, 2130. In this way the flanges 2154 do not interfere with the interaction of the side rails 2128, 2130 and the guides 2138.

Similarly, the flanges 2154 do not extend further upwardly than the top rails 2124, 2126. In the drawings, the flanges 2154 are raised slightly from the top rails 2124, 2126 to permit passage of the flanges over a raised portion of one of the top guides 2136.

Figure 6:
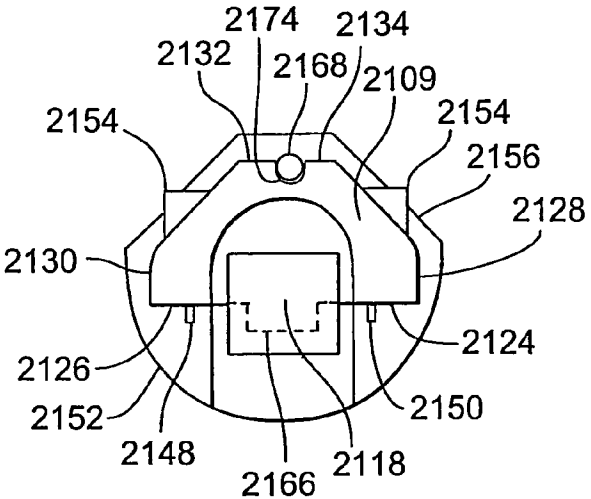
FIG. 6 is a rear view of the battery drawer of FIG. 1.
Figure 7:
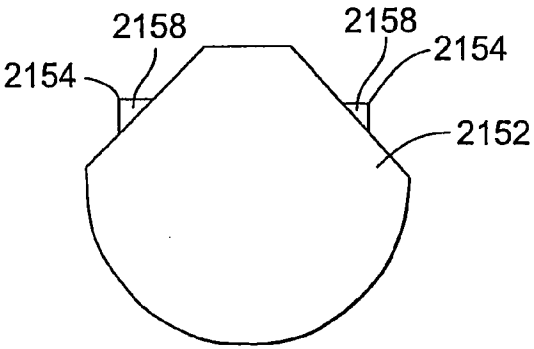
FIG. 7 is a front view of the battery drawer of FIG. 1.

As can best be seen in FIG. 6, the bed 2110 has a semicircular section 2142 with straight extensions 2144, 2146. The bottom surfaces of the extensions 2144, 2146 form the rails 2124, 2126. The extensions 2144, 2146 also extend outwardly beyond the rear crib end 2114 to provide stop surfaces 2164. The stop surface 2164 engages shell 2143 in the event that a upward rotational force is applied on the drawer 2106 when it is extended. In addition, the extensions 2144, 2146 also provide additional support to the crib ends 2112, 2114 while not obstructing access to the battery 2102.

The crib ends 2112, 2114 have respective supports 2166 that extend below the bottom rails 2132, 2134. The supports 2166 provide support to the contacts 2116, 2118 to provide the proper alignment with the battery electrodes.

Between the cap 2152 and the end 2112 is a slot 2167 for receiving one end of contact 2116 to which an insulated conductor wire 2168 is attached by soldering or otherwise. There is a groove 2170 in the end 2112 along which the wire 2168 can run to a hole 2172 through the overside of the drawer 2106. The hole 2172 exits at a channel 2174 between the top guides 2136. The wire 2168 can run in the channel 2174 so as not to affect the sliding operation of the drawer 2106.

Figure 8:
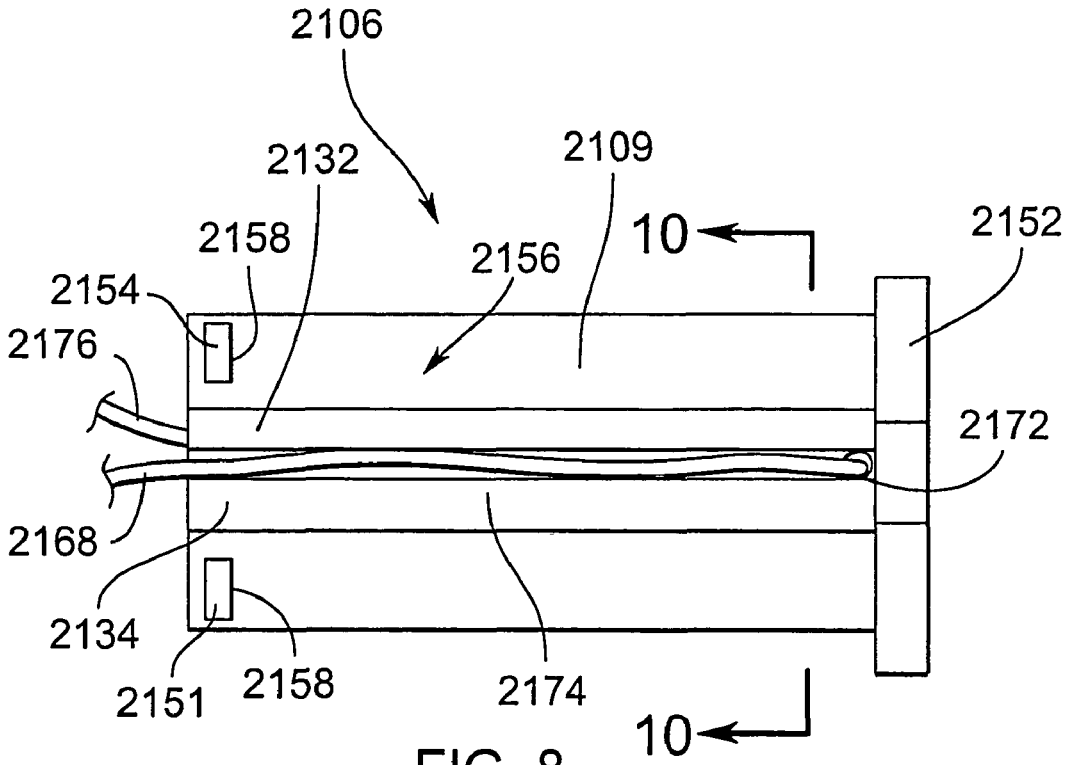
FIG. 8 is a top view of the battery drawer of FIG. 1 with connecting wires.
Figure 9:
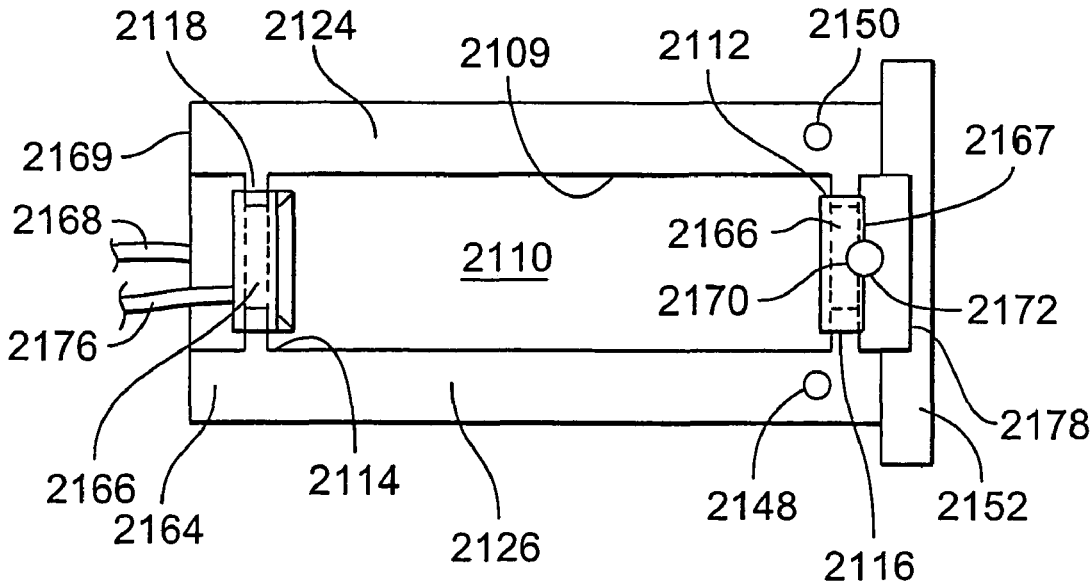
FIG. 9 is a bottom view of the battery drawer of FIG. 1 with connecting wires.

A wire 2176 from the other contact 2118 can simply extend from rear of the drawer 2106. The wires 2168, 2176 should have sufficient slack within the handle 2100 to allow sliding of the drawer 2106. The wires 2168, 2176 are shown in FIGS. 3, 8 and 9 and partially in FIGS. 6 and 10, but not the other FIGS for clarity.

The wires 2168, 2176 can be extended to any required locations within the handle 2100. The guides 2136, 2138 and that part of the shell 2143 adjacent to the aperture 2145 form a battery compartment 2177 of the handle 2100. The compartment 2177 can be placed at any accessible and available location in the handle 2100.

A groove 2178 extends into rear 2180 of the cap 2152. The groove 2178 is externally accessible when the cap 2152 is closed. This provides a visual indication to the user that the drawer 2106 is operable. The groove 2178 provides a point of entry for a fingernail or a tool, such as a coin or table knife, to be used to begin the sliding motion.

As is typical for existing hose handles, the shell 2143 is preferably formed from a hard plastic for the housing 2106. For ease of design and manufacture, the drawer 2106 can be formed from the same material as the shell 2143; however, another hard resilient material may be used. The compartment 2177 could be a separate piece from the shell 2143 that is snapped into, or otherwise held in fixed relation to, the shell 2143. The compartment 2177 can be partially or fully sealed from the remainder of the handle 2100, subject to access to the wires 2168, 2176. This may be advantageous to prevent dirt or another matter from entering the handle 2100 through the aperture 2145.

Referring to FIG. 11, the hose handle 2100 and housing 2106 are shown in use in a central vacuum cleaning system indicated generally as 2300 in use in a dwelling 2301 by an operator 2302. The system 2300 has a central vacuum unit 2303 connected through pipes 2304 and wall valves 2306 to hose 2105. As indicated previously, hose 2105 is connected to handle 2100. Handle 2100 is connected to wand adapter 2104. Wand extensions 2308 are connected to cleaning attachments 2310. As is known to those skilled in the art many alternative configurations are possible for central vacuum cleaning systems, some of which are discussed in the Background section hereof.

Figure 12:
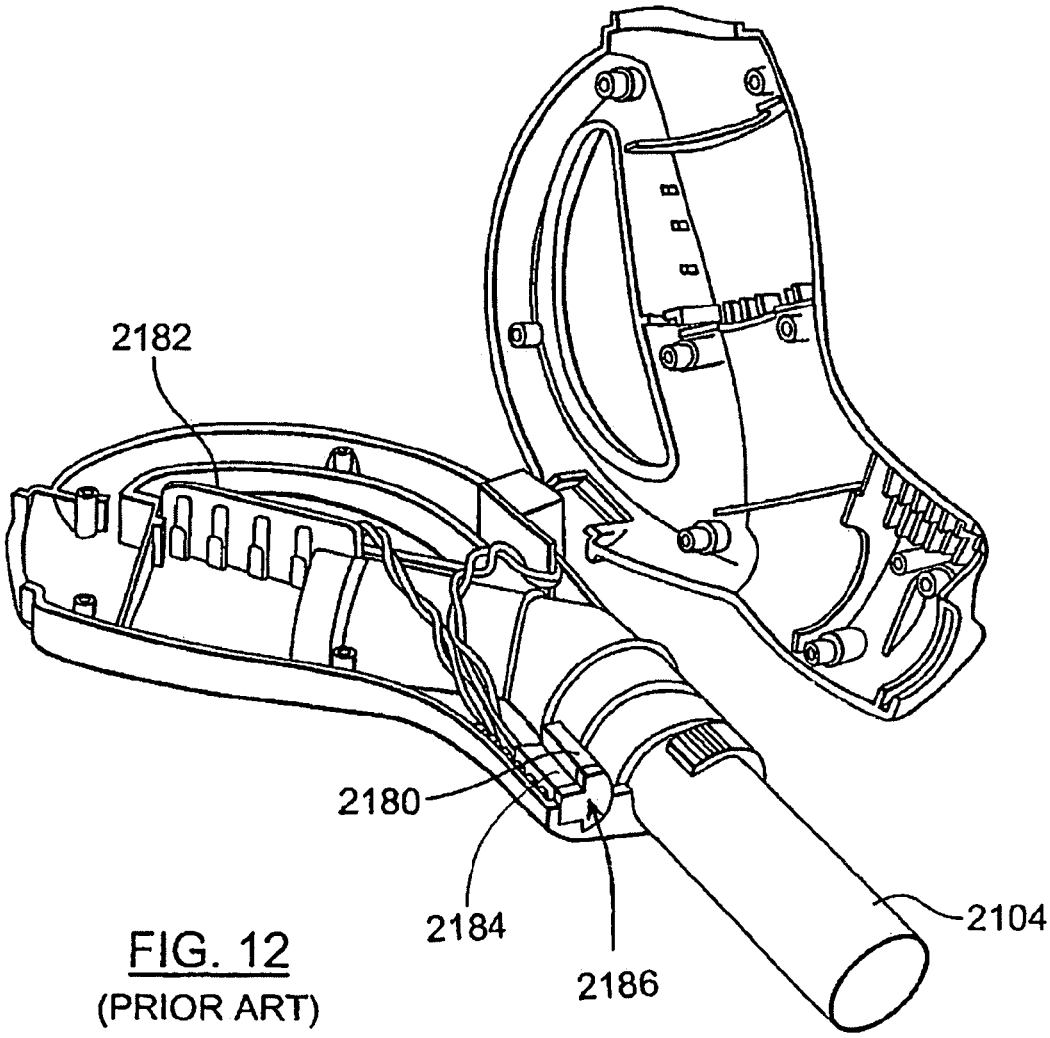
FIG. 12 (PRIOR ART)
FIG. 12 (PRIOR ART) is an exploded perspective view similar to that of FIG. 3 with an attachment power plug in place of the battery drawer of FIG. 1.

Referring to FIG. 12, it has been found to be particularly advantageous to utilize a single handle shell 2143 for either battery power source and line power source configurations. In battery powered configurations the battery drawer 2106 can be used as described above. In line powered applications an attachment power plug 2180 (for connection to powered cleaning attachment such as a powered brush roll 2310, FIG. 11) and hose handle power interface 2182 (for receiving low voltage communication wires and line power wires from the central vacuum cleaning system hose, not shown in FIG. 12) can be used as in existing handles today. For example, the hose handle 2100 and attachment plug 2180 shown in the drawings are those found in a Progression™ hose handle manufactured for Plastiflex of Orangeville, Ontario, Canada. The components to which the different power sources are connected within the handle 2100 will likely differ, for example, battery powered applications will lend themselves to wireless communication as mentioned previously, while line powered applications will likely connect through the hose handle power interface 2182 to wires in a hose as mentioned above.

The power plug 2180 has a plug housing 2184 that is physically configured for retention by the handle 2100 while providing access to plug connections 2186.

The drawer 2106 should be designed to fit within and utilize without modification the same compartment 2177 as the attachment power plug 2180. For example, the drawer 2106 described above has been configured to utilize posts 2188 and 2190 as bottom guides 2140, ribs 2192 (one of which is indicated with a reference numeral in FIG. 3) as top guides 2136 and side guides 2138 (two of which are indicated with a reference numeral in FIG. 3). The compartment 2177 is made up of the posts 2188, 2190, ribs 2192 and that part of the shell 2143 adjacent to the aperture 2145. The aperture 2145 has an arrow head configuration as this is the shape of the plug tip 2194 used in the preferred embodiment. The plug 2180 has a shoulder 2196 that extends outwardly to rest against the shell 2143 and to stop the plug 2180 from exiting the handle 2100 through the aperture 2145 when in use. As will be evident to those skilled in the art other stops or other means altogether could be used to fix the plug 2180 within the handle 2100. Similarly, other means could be used altogether to retain the housings 2106, 2200 (FIG. 13) within the handle

2100 provided that external access (access external to the handle 2100) to the battery 2102 is available and the housing 2182 is interchangeable with housing 2106, 2200.

Existing handles may be easily converted from line power source to battery applications using the aperture 2145. Thus, the hose handle 2100 may be easily converted between battery and line power source configurations. A manufacturer need only produce one handle 2100 for both applications.

The drawer 2106 may take on many different configurations and placements within the handle 2100. It has been found to be particularly advantageous to place the drawer 2106 such that the drawer 2106 is beneath the wand adapter 2105 such that the crib 2109 opens away from the wand adapter 2105. This allows the user to simply shake the drawer 2106, possibly by tapping or shaking the handle 2100, to cause the battery to fall from the drawer 2106.

While this is an advantageous position, it is still possible to orient the drawer 2106 in a completely different position, for example above the wand adapter 2104. If there is sufficient room between the wand adapter 2104 and the drawer 2106 to access the battery 2102 then the drawer 2106 could open with the crib 2109 opening downwardly. Alternatively, the drawer 2106 could open with the crib 2108 opening upwardly. Where the crib 2109 opens upwardly, the user could twist the handle with the wand adapter axis 2107 oriented upwardly and the battery 2102 could again be caused to fall from the crib 2109.

The drawer 2106 could take on many other orientations, for example, perpendicular to the axis 2107 or at any other angle. Corresponding modifications would be required to the shell 2143 for any change in orientation from that shown in the FIGS.

The crib 2109 could have a different configuration to house alternate battery sizes and shapes. The battery 2102 shown in the drawings is a VINNIC L1028 12V 23A manufactured by Chung Pak Battery Works Ltd. and distributed by Evergreen (C.P.) U.S.A. Inc. of San Francisco, Calif. This battery 2102 is readily available and has sufficient life to power basic on/off wireless communications for a hose handle 2100 of a central vacuum cleaning system 2300. Other configurations, for example, may include a bed, not shown, with three flat sides to house a battery with a rectangular cross-section.

Similarly, the overside 2156 of the drawer 2106 could have other cross-sections provided that it is dimensioned to fit through the aperture 2145. Rails and guides could be interchanged so that the rails are on battery compartment 2177 and the guides are on the drawer 2106. It is not necessary to have six rails, provided that the drawer 2106 is limited from movement up and down and side to side, and allowed to slide in and out and provides access to the battery 2102. For example, three rail/guide combinations equal spaced about the drawer 2106 could hold the drawer 2106 in place.

Alternative configurations might include a cap that does not extend to cover the aperture 2145, rather the cap fits within the aperture 2145 flush with the shell 2143. The drawer 2106 could include an internal stop to limit the distance the drawer 2106 is inserted into the handle 2100. An externally accessible pull tab or catch could be used to pull the drawer 2106 to be useful.

The battery compartment 2104 need not be used in association with all or any of the other central vacuum cleaning system aspects described herein. It is only required that the central vacuum cleaning system hose handle 2100 have a battery for use within the system in order for the compartment 2104 and drawer 2106 to be useful.

Figure 13:
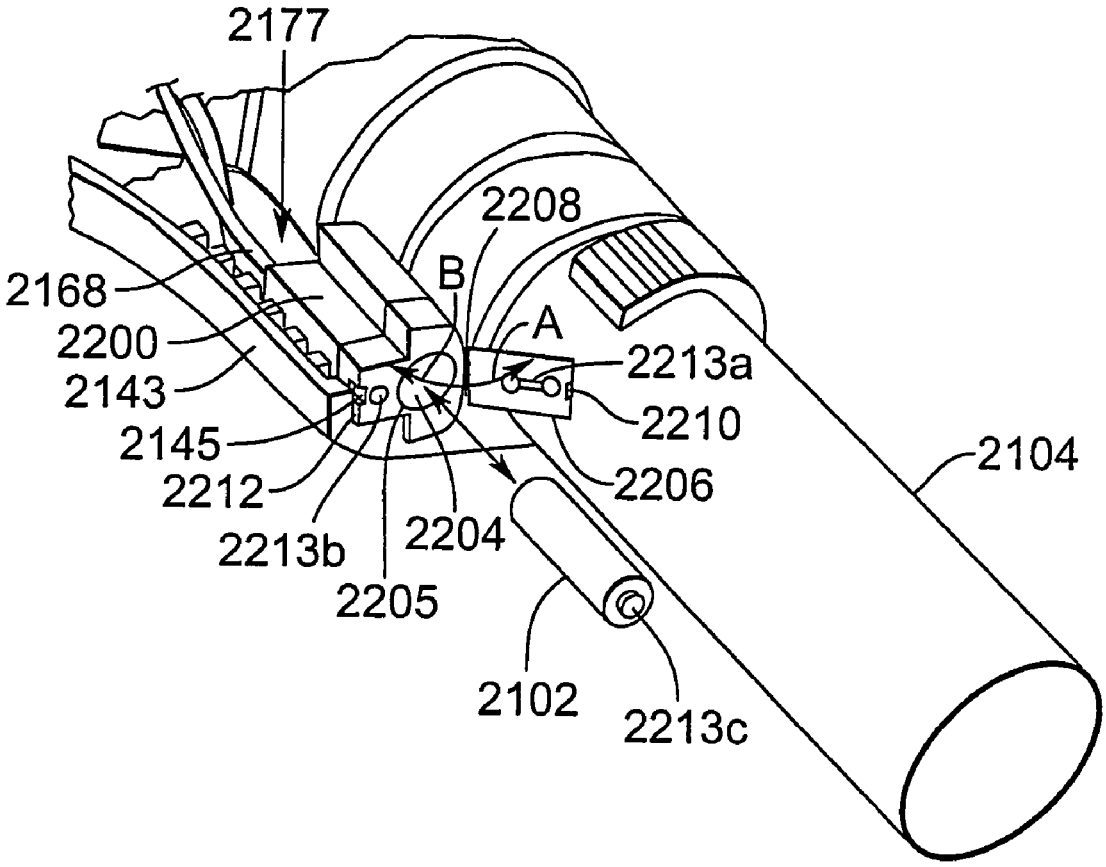
FIG. 13 is a portion of an exploded perspective view similar to that of FIG. 3 with a battery housing in accordance with an alternative embodiment of the present invention in place of the battery drawer of FIG. 1.

Referring to FIG. 13, in another embodiment the compartment 2177 retains a battery housing 2200. The housing 2200 has an external profile similar to the plug housing 2180. Again, the housing 2200 has an external profile that fits within the compartment 2177 and the housing 2200 is retained by the compartment 2177. The housing 2200 has a body 2202 with an internal chamber 2204 to receive the battery 2102. The body 2202 has an opening 2205 to provide access through the aperture 2145 to the chamber 2204.

The housing 2200 has a cap 2206 that has an open position A and a closed position B, such that access external to the handle 2100 is provided to the battery 2102 in the chamber 2204 through the aperture 2145 when the cap 2206 is in the open position A, while such access is prevented when the cap 2206 is in the closed position B. Attachment of the cap 2206 to the body 2202 can be temporary or permanent. For example, the cap 2206 may be hingedly connected to the body 2202, such that the cap 2206 swings on a hinge, such as living hinge 2208, between the open position A and closed position B. In the closed position B some form of lock can be provided between the cap 2206 and body 2202 to prevent the cap 2206 from opening inadvertently. The lock can be as simple as a tab with boss 2210 on one of the cap 2206 and body 2202 and a corresponding hollow 2212 on the other of the cap 2206 and body 2202. A spring mechanism can be provided, for example the living hinge 2208 may be biased to open position A, to allow the cap 2206 to pop open when unlocked. Although advantageous, a spring mechanism is not necessary for those configurations where a simple shake of the handle 2100, with or without battery 2102, will cause the cap 2206 to move to the open position A. The cap 2206 has a double contact 2213*a*, while the body has a contact 2213*b* to provide electrical connection from battery electrode 2213*c* to wire 2168. The remainder of the handle 2100 and wiring is the same as that of FIG. 3.

Figure 14:
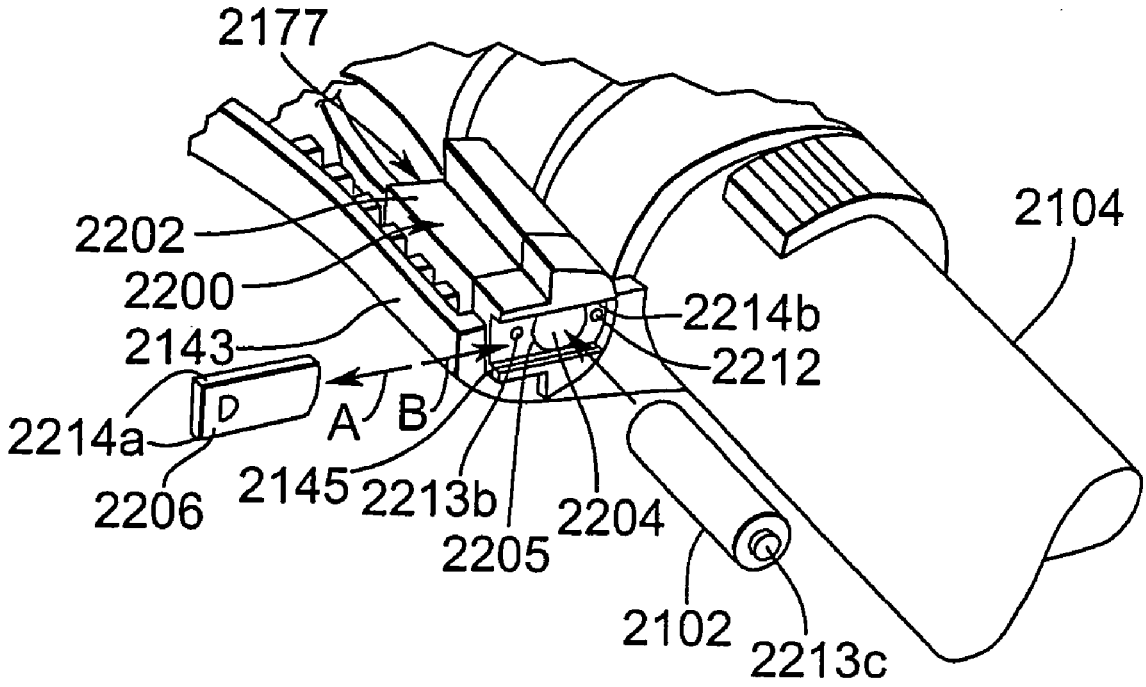
FIG. 14 is an exploded perspective view similar to that of FIG. 13 with a battery housing in accordance with a further alternative embodiment of the present invention in place of the battery drawer of FIG. 1.

Referring to FIG. 14, alternatively, the cap 2206 of the housing 2200 may be attached to the body 2202 by way of corresponding guide mechanisms 2214*a*, 2214*b*, such that the cap 2206 slides into and out of the body 2202 to cover access to the chamber 2204. The housing 2200 of FIG. 14 is otherwise similar to the housing 2200 of FIG. 13.

Other configurations of battery housings and compartments within central vacuum cleaning system hose handles to house a battery within a compartment of a hose handle and allow external access to the battery through an aperture in the handle will be evident to those skilled in the art based on the principles described herein. Such a housing and compartment will include a housing that is interchangeable within a hose handle compartment with a line power source plug housing.

It will be understood by those skilled in the art that this description is made with reference to the preferred embodiment and that it is possible to make other embodiments employing the principles of the invention which fall within its spirit and scope as defined by the following claims.

I claim:

1. A combination for use within a central vacuum cleaning system, the combination comprising:

a) a central vacuum cleaning system hose handle including a battery compartment, and a battery housing for releasably retaining a battery, wherein the battery compartment is within the handle and has an aperture through the handle to provide external access to the compartment through the handle, wherein the housing has an open position and a closed position, wherein external access to the battery is prevented when the housing is in the closed position, wherein external access to the battery is permitted when the housing is in the open position, wherein the housing is a drawer, wherein the drawer and compartment have a slide mechanism on which the drawer can be extended into and out of the handle through the aperture, wherein the drawer and compartment have a first stop to limit the depth to which the drawer can slide into the handle through the aperture, wherein the drawer and compartment have a second stop to limit the depth to which the drawer can be extended out of the handle through the aperture, wherein external access to the battery is prevented when the drawer is extended into the handle to the first stop, and wherein external access to the battery is permitted when the drawer is extended out of the handle to the second stop.

2. The combination of claim 1 wherein the battery housing is interchangeable with an attachment power plug housing such that the hose handle may be combined with either the battery housing or the plug housing.

3. The combination of claim 1 wherein the battery housing has an external profile similar to the plug housing.

4. The combination of claim 1 wherein the slide mechanism comprises a combination of rails and guides on the drawer and compartment.

5. The combination of claim 4 wherein the drawer and compartment further comprise a boss that inhibits the drawer from extending out of the compartment when the handle is in use.

6. The combination of claim 1 wherein the slide mechanism comprises a combination of rails on the drawer and guides on the compartment.

7. The combination of claim 6 wherein the drawer further comprises a boss on one of the rails to releasably engage the handle at the aperture to inhibit the drawer from extending out of the compartment when the handle is in use.

8. The combination of claim 1 wherein the drawer and compartment further comprise a releasable locking mechanism to inhibit the drawer from extending out of the compartment when the handle is in use.

9. The combination of claim 1 wherein the slide mechanism comprises a releasable locking mechanism to inhibit the drawer from extending out of the compartment when the handle is in use.

10. The combination of claim 1 wherein the handle comprises an external shell and the aperture is in the shell.

11. The combination of claim 1 wherein the drawer comprises a crib, and the drawer releasably retains the battery in the crib.

12. The combination of claim 11 wherein the drawer further comprises a first contact at one end of the crib and a second contact at an opposing end of the crib, and wherein the drawer releasably retains the battery between the contacts in the crib.

13. The combination of claim 12 wherein at least one of the contacts is a spring contact to releasably retain the battery between the contacts within the crib.

14. The combination of claim 11 wherein the crib has bed that is generally formed to a longitudinal profile of the battery.

15. The combination of claim 11 wherein the crib has a curved bed for receiving a cylindrical battery.

16. The combination of claim 11 wherein the drawer is oriented generally parallel to a longitudinal wand adapter axis of the handle and the crib opens away from the wand adapter axis.

17. The combination of claim 16 wherein the crib opens from beneath the wand adapter axis when the handle is held in a normal operating position with the wand adapter axis directed downwardly.

18. A battery drawer for releasably retaining a battery in a central vacuum cleaning system hose handle having a compartment for retaining a central vacuum cleaning system attachment power plug and an aperture through the handle to provide external access to the plug, the drawer comprising:

a) a first slide mechanism portion, b) a first stop surface, and c) a second stop surface, wherein battery drawer releasably retains the battery, and wherein the first slide mechanism portion acts in combination with the compartment to provide a slide mechanism on which the drawer can be extended into and out of the handle through the aperture, and wherein the first stop surface acts in combination with the compartment to provide a first stop to limit the depth to which the drawer can slide into the handle through the aperture; and wherein the second stop surface in combination with the compartment to provide a second stop to limit the depth to which the drawer can be extended out of the handle through the aperture, and wherein external access to the battery is prevented when the drawer is extended into the handle to the first stop, and wherein external access to the battery is permitted when the drawer is extended out of the handle to the second stop.

19. The drawer of claim 18 wherein the first slide mechanism portion comprises rails.

20. The drawer of claim 19 wherein the drawer further comprises a boss on one of the rails to releasably engage the handle at the aperture to inhibit the drawer from extending out of the compartment when the handle is in use.

21. The drawer of claim 18 wherein the drawer further comprises a releasable locking mechanism to inhibit the drawer from extending out of the compartment when the handle is in use.

22. The drawer of claim 18 wherein the drawer further comprise a boss that inhibits the drawer from extending out of the compartment when the handle is in use.

23. The drawer of claim 18 wherein the drawer comprises a crib, and the drawer releasably retains the battery in the crib.

24. The drawer of claim 23 wherein the drawer further comprises a first contact at one end of the crib and a second contact at an opposing end of the crib, and wherein the drawer releasably retains the battery between the contacts in the crib.

25. The drawer of claim 24 wherein at least one of the contacts is a spring contact biased to releasably retain the battery between the contacts within the crib.

26. The drawer of claim 23 wherein the crib has a bed that is generally formed to a longitudinal profile of the battery.

27. The drawer of claim 23 wherein the crib has a curved bed for receiving a cylindrical battery.

28. The drawer of claim 23 wherein the drawer is oriented generally parallel to a longitudinal wand adapter axis of the handle and the crib opens away from the wand adapter axis.

29. The drawer of claim 28 wherein the crib opens from beneath the wand adapter axis when the handle is held in a normal operating position with the wand adapter axis directed downwardly.

30. A combination for use in a central vacuum cleaning system, the combination comprising:

a) a central vacuum cleaning system hose handle for use with a battery to power at least one device, and b) a battery housing retained by the hose handle, the battery housing comprising an open position to provide access to the battery external to the handle such that the battery can be removed from or inserted into the housing, and a closed position to retain the battery and prevent access to the battery, wherein the battery housing is a battery drawer, wherein in the open position the drawer extends out of the handle to provide access to the battery external to the handle, and wherein in the closed position the drawer extends into the handle to retain the battery and prevent access to the battery, and wherein the drawer comprises a crib with an interior curved bed, opposing first crib end and second crib end, a first electrical contact extending into the crib from the first crib end, and a second electrical contact extending into the crib from the second crib end.

31. The combination of claim 30 wherein the battery housing is compatible with a compartment within the hose handle that is also compatible with an attachment power plug housing such that the hose handle may be combined with either the battery housing or the plug housing.

32. The combination of claim 30 wherein the battery housing has an external profile similar to the plug housing.

33. The combination of claim 30 wherein the crib and contacts are dimensioned such that the battery is retained within the crib after the battery is placed is the crib.

34. The combination of claim 30 wherein the contacts are spring type contacts that allow the battery to be manually inserted and removed while firm contact is maintained between the contacts and electrodes of the battery when the battery is in the crib.

35. The combination of claim 30 wherein the drawer and handle have a plurality of rail/guide combinations spaced about the drawer parallel to a longitudinal axis of the drawer on which the drawer can slide between the open position and the closed position.

36. The combination of claim 30 wherein the handle further comprises an exterior shell that extends about the handle, and an aperture in the shell, and wherein the drawer slides through the aperture.

37. The combination of claim 36 wherein the drawer and shell comprise a manually releasable locking mechanism for the drawer.

38. The combination of claim 30 wherein the handle has two attached casing halves.

39. The combination of claim 38 wherein the drawer is inserted in the handle before the halves are attached.

40. A combination for use in a central vacuum cleaning system, the combination comprising:

a) a central vacuum cleaning system hose handle for use with a battery to power at least one device, and b) a battery housing retained by the hose handle, the battery housing comprising an open position to provide access to the battery external to the handle such that the battery can be removed from or inserted into the housing, and a closed position to retain the battery and prevent access to the battery, wherein the battery housing is a battery drawer, wherein in the open position the drawer extends out of the handle to provide access to the battery external to the handle, and wherein in the closed position the drawer extends into the handle to retain the battery and prevent access to the battery, and wherein the drawer and shell comprise a manually releasable locking mechanism for the drawer.

* * * * *